United States Patent [19]

Vollenweider

[11] 4,098,555

[45] Jul. 4, 1978

[54] DEVICE FOR JOINING TWO STRUCTURAL PARTS

[75] Inventor: Karl Vollenweider, Wagenhausen, Switzerland

[73] Assignee: Swiss Aluminium Ltd., Chippis, Switzerland

[21] Appl. No.: 663,081

[22] Filed: Mar. 2, 1976

[30] Foreign Application Priority Data

Mar. 11, 1975 [CH] Switzerland ..... 3098/75

[51] Int. Cl.[2] ..... B25G 3/00

[52] U.S. Cl. ..... 403/20; 403/168; 52/582

[58] Field of Search ..... 52/758 C, 758 D, 758 F, 52/753 C, 754, 578, 582, 282, 235, 127, 509, 476, 475; 403/289, 290, 167, 18, 168, 19, 20

[56] References Cited

U.S. PATENT DOCUMENTS

| | | | |
|---|---|---|---|
| 2,569,941 | 10/1951 | Mastrangelo et al. | 52/509 X |
| 3,082,849 | 3/1963 | Keller | 52/758 C X |
| 3,466,826 | 9/1969 | Gallagher et al. | 52/235 X |
| 3,713,677 | 1/1973 | Du Preez | 403/290 X |
| 3,724,886 | 4/1973 | Widerby | 52/758 F X |
| 3,837,128 | 9/1974 | O'Brien | 52/282 X |

FOREIGN PATENT DOCUMENTS

| | | | |
|---|---|---|---|
| 784,302 | 10/1957 | United Kingdom | 52/754 |

*Primary Examiner*—Wayne L. Shedd
*Attorney, Agent, or Firm*—Ernest F. Marmorek

[57] ABSTRACT

A device for joining the frames of structural units which are structural units having undercut grooves. The device is provided engages itself in these grooves, and is preferably in the form of a spindle consisting of two parts which rotate with respect to each other on a common threaded shaft or axis. By rotating the defice each of the two parts anchors itself firmly into the undercut grooves in the frames which may be metal sections thus holding the frames together.

5 Claims, 14 Drawing Figures

Fig. 4 b
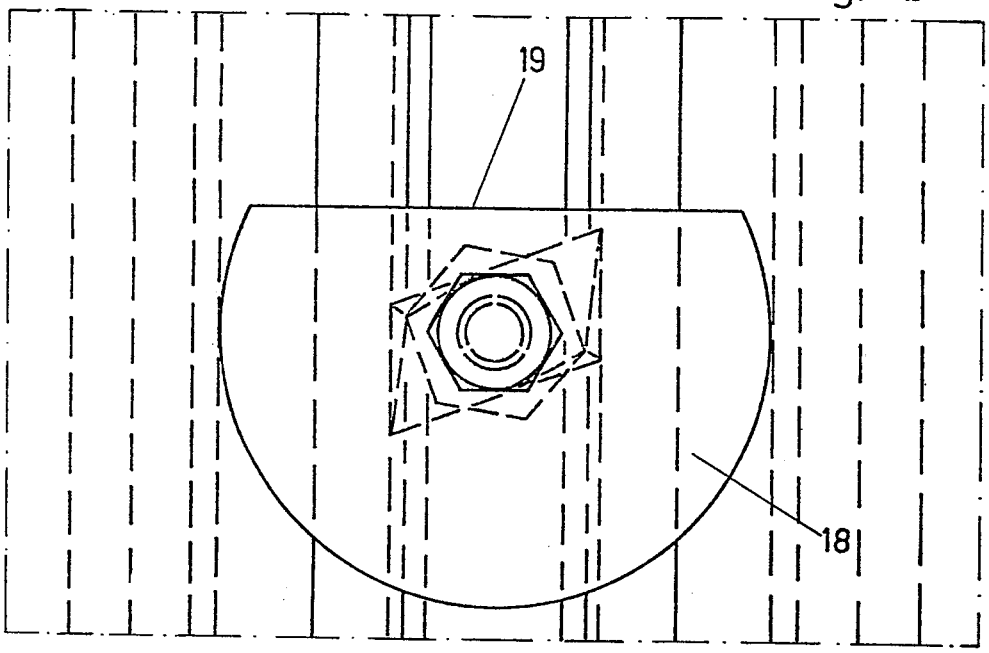
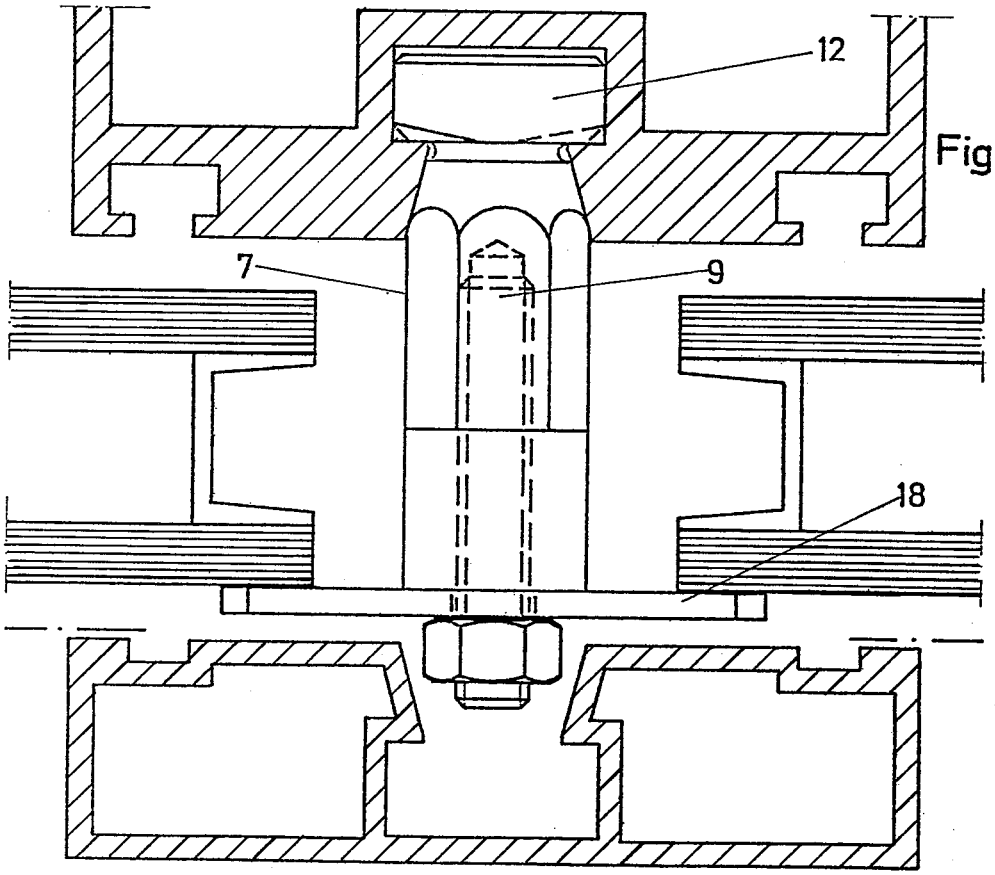
Fig. 4a

DEVICE FOR JOINING TWO STRUCTURAL PARTS

Reference is hereby made to companion patent application by Heinrich Teidecken which has issued on May 18, 1976 as U.S. Pat. No. 3,956,863, and is assigned to the assignee of the instant application.

The invention concerns a device for joining two facing structural parts which exhibit grooves undercut on both sides. Such parts occur especially in the construction of window or door frames, metal/glass walls and the like, in particular when a thermal break is desired between the outside and the interior, and for this latter purpose a large number of suggestions have already been made. These known methods however often have disadvantages e.g. complicated, time-consuming assembly, or it is impossible to dismantle the unit without damaging or destroying the components, making it impossible to re-use the parts.

These disadvantages are avoided by the device of the invention which is basically a bolt composed of two coaxial parts which can be rotated with respect to each other, each of the two parts having means which engages via a clamping action one of the the shoulders of one of the undercut grooves.

In other words, the invention is a device for releasably joining together two abutting frames of a structural unit the facing sides of which frames are provided with grooves which are undercut on each side thereof, in which the device engages. The device comprises a spindle, one end of which carries a releasable means adapted to engage or fit into the undercut of the groove of a structural frame and the other end of which carries a parallelopipedon of rhomboidal cross-section which is rigidly and transversely attached thereto. The diagonal of the parallelopipedon is sufficiently long so that the parallelopipedon, when centered in the groove, engages the shoulders of the undercut when the spindle is rotated less than ¼ of a revolution after insertion in the groove. The releasable means can be a forked member (as described below) or another parallelopipedon, as described.

The spindle can be cut transversely at its midpoint, in which event the resulting halves are joined by an interior axial bolt.

The bolt is fixed into and projects from one of the halves and is retained in the other half by engagement with axial inner threads therein. The two halves are thus rotatable with respect to each other and can be screwed together.

The invention will now be explained in greater detail with the aid of drawings showing examples. The FIGS. 1*a*, 2*a*, 3*a*, 4*a*, 5*a* and 6*a* represent side views (metal section shown in cross section) of various versions and FIGS. 1*b*, 2*b*, 3*b*, 4*b*, 5*b* and 6*b* the corresponding plan views, while FIG. 7 shows an adjustable spanner, likewise in side and plan views, and which is suitable for adjusting the device.

Figure 1B:
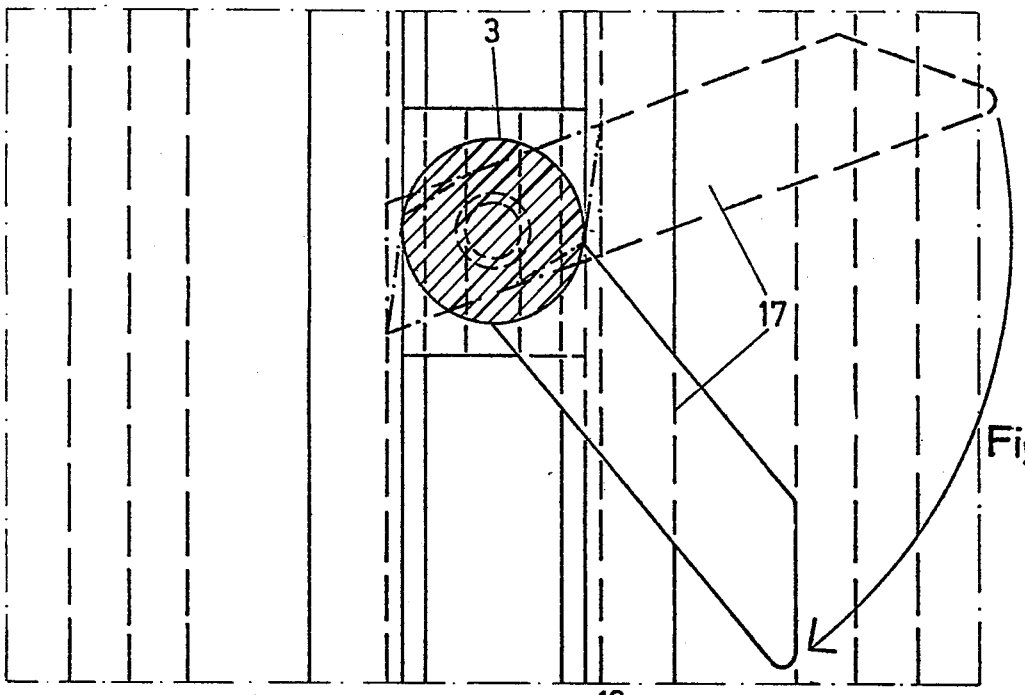
Figure 1A:
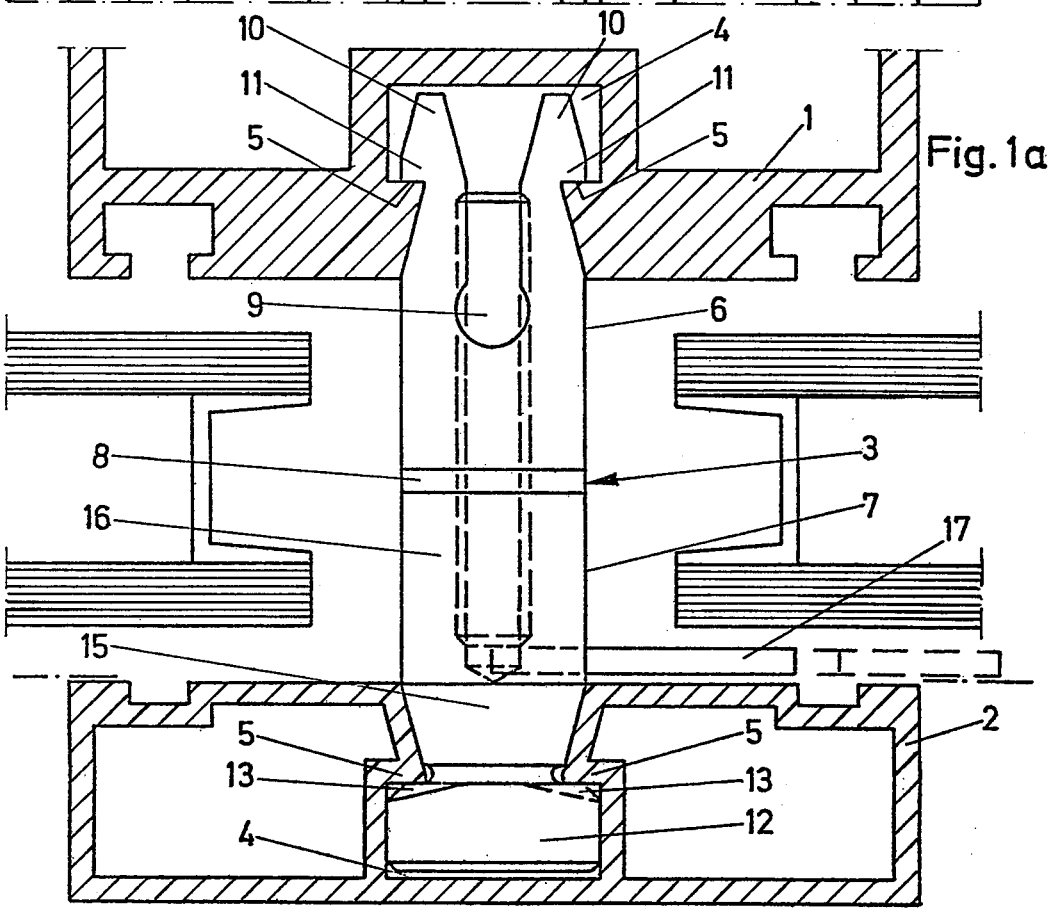
Figure 2B:
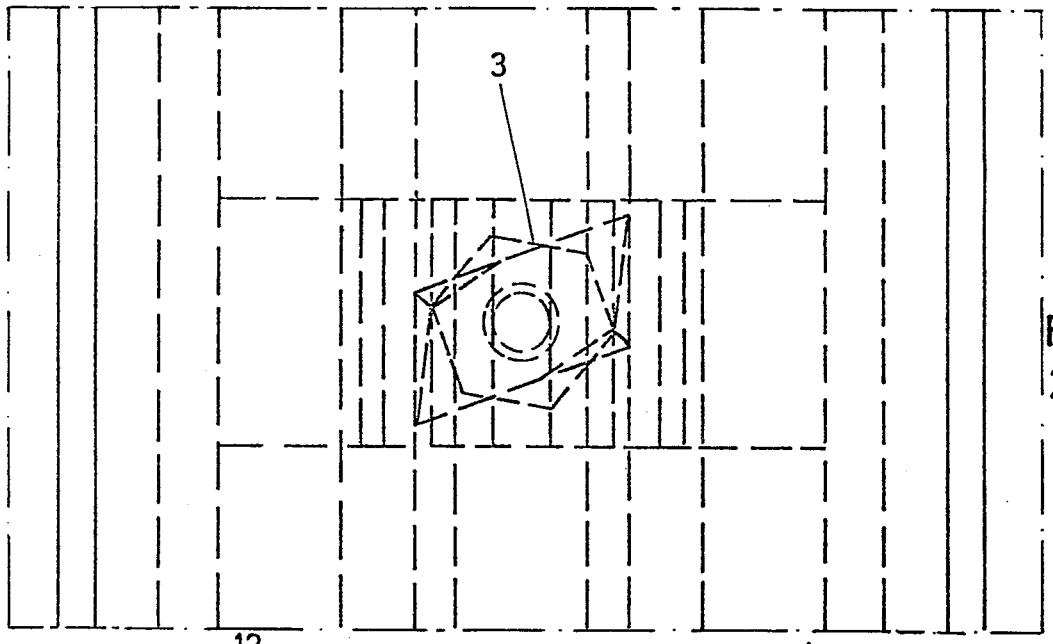
Figure 2A:
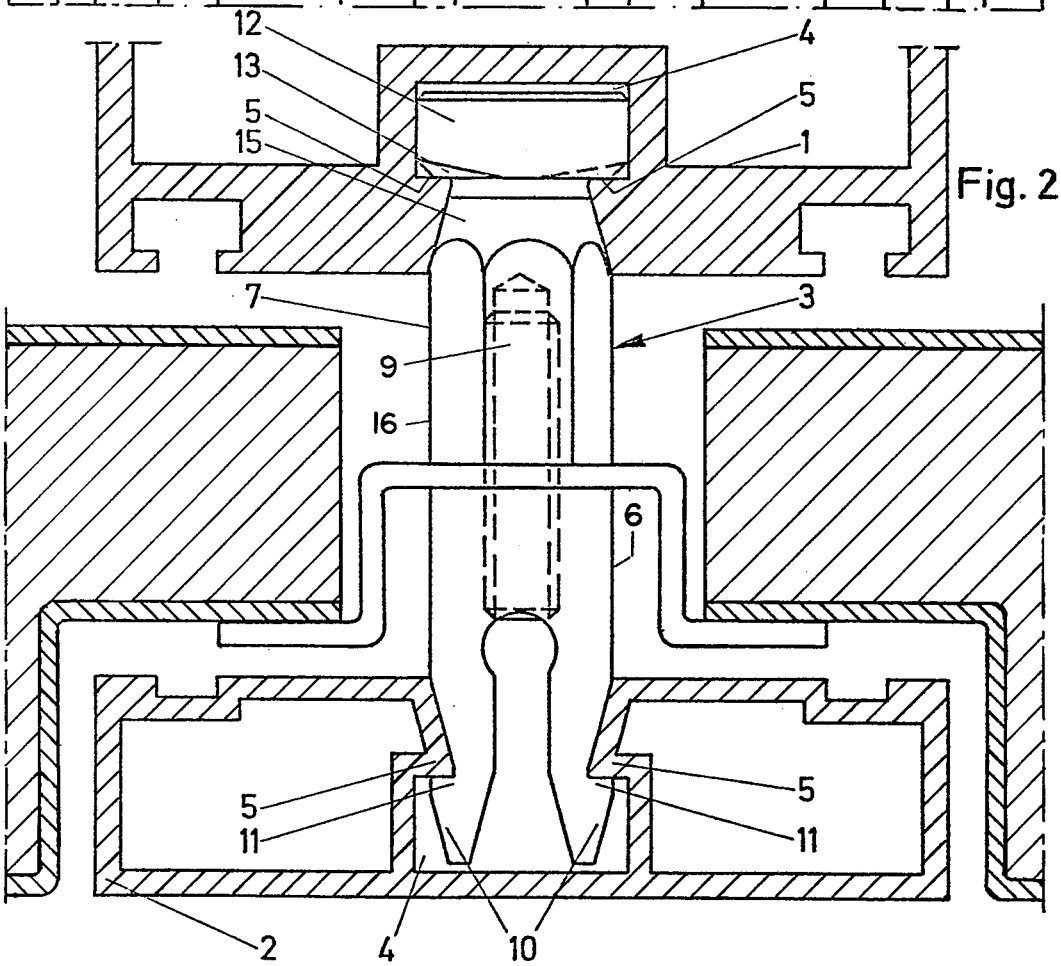
Figure 3B:
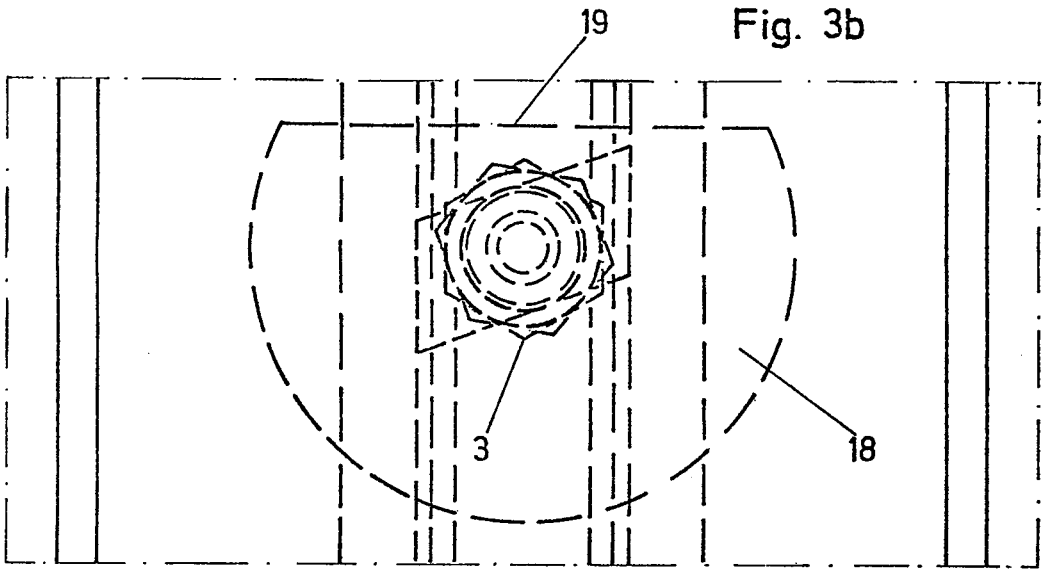
Figure 3A:
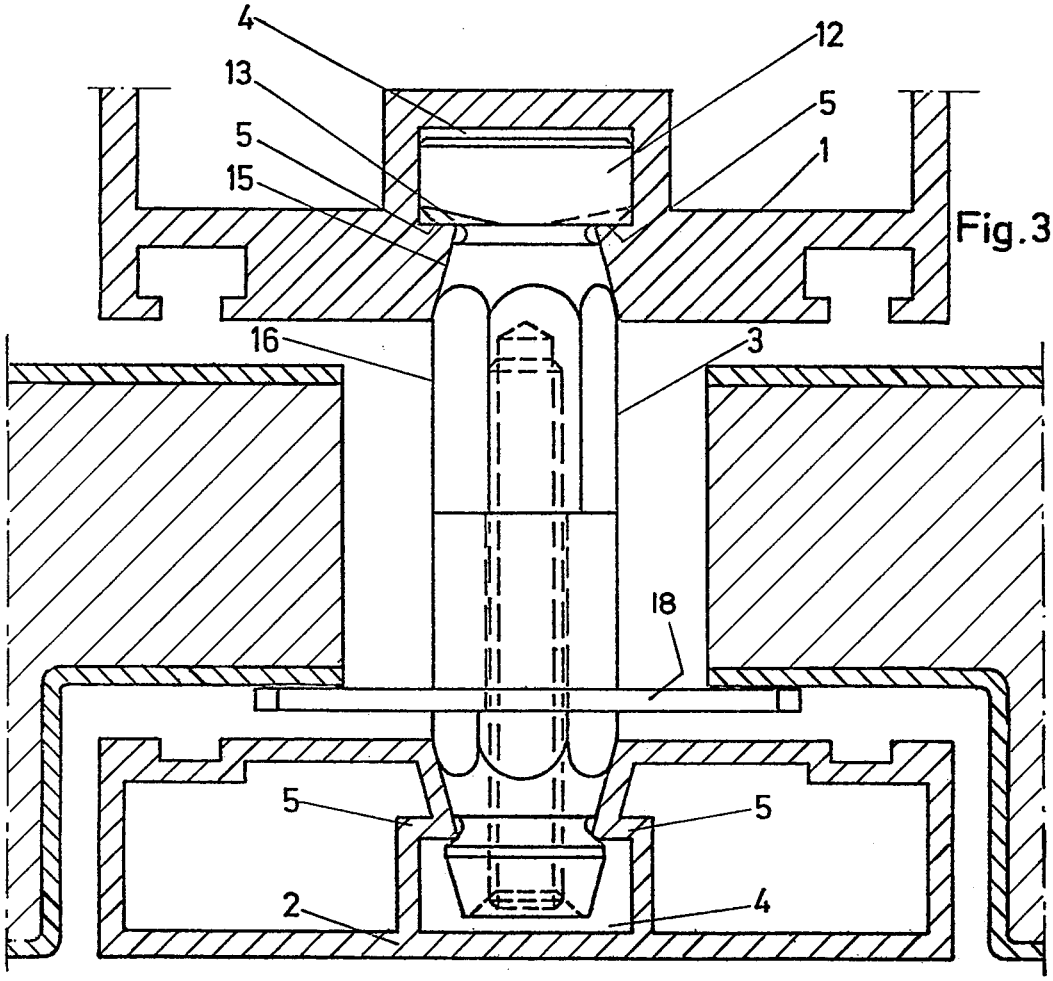
Figure 5B:
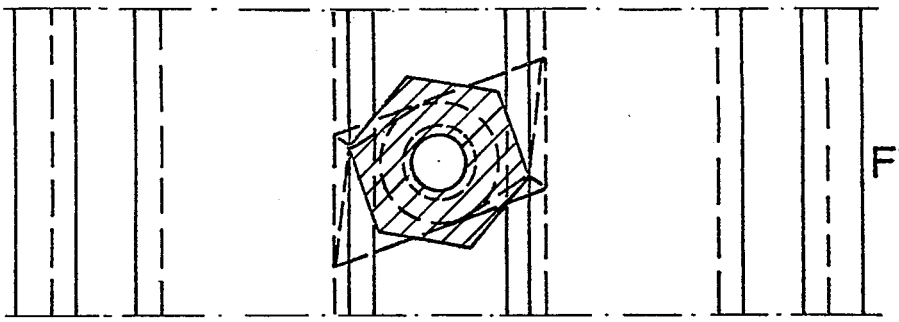
Figure 5A:
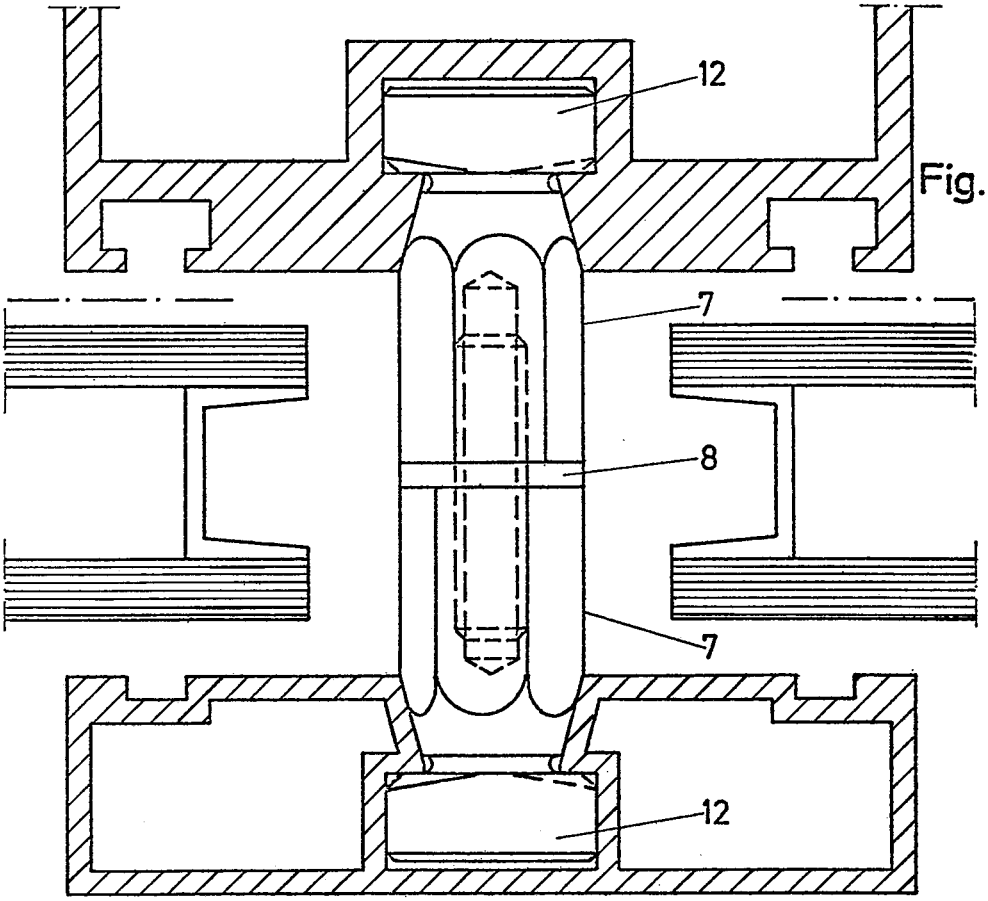
Figure 6B:
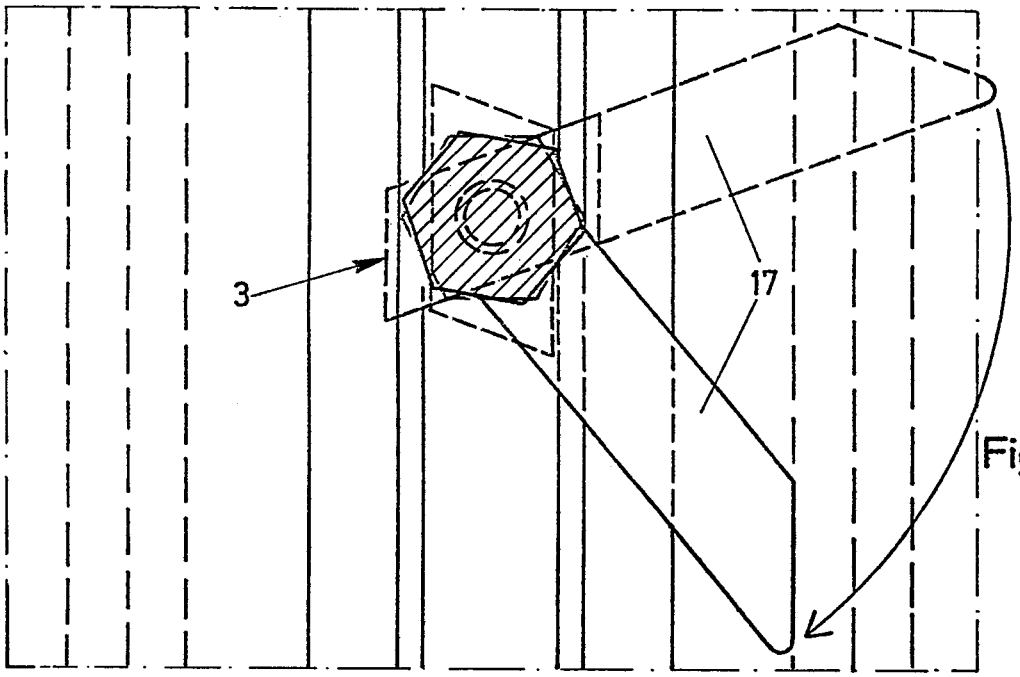
Figure 6A:
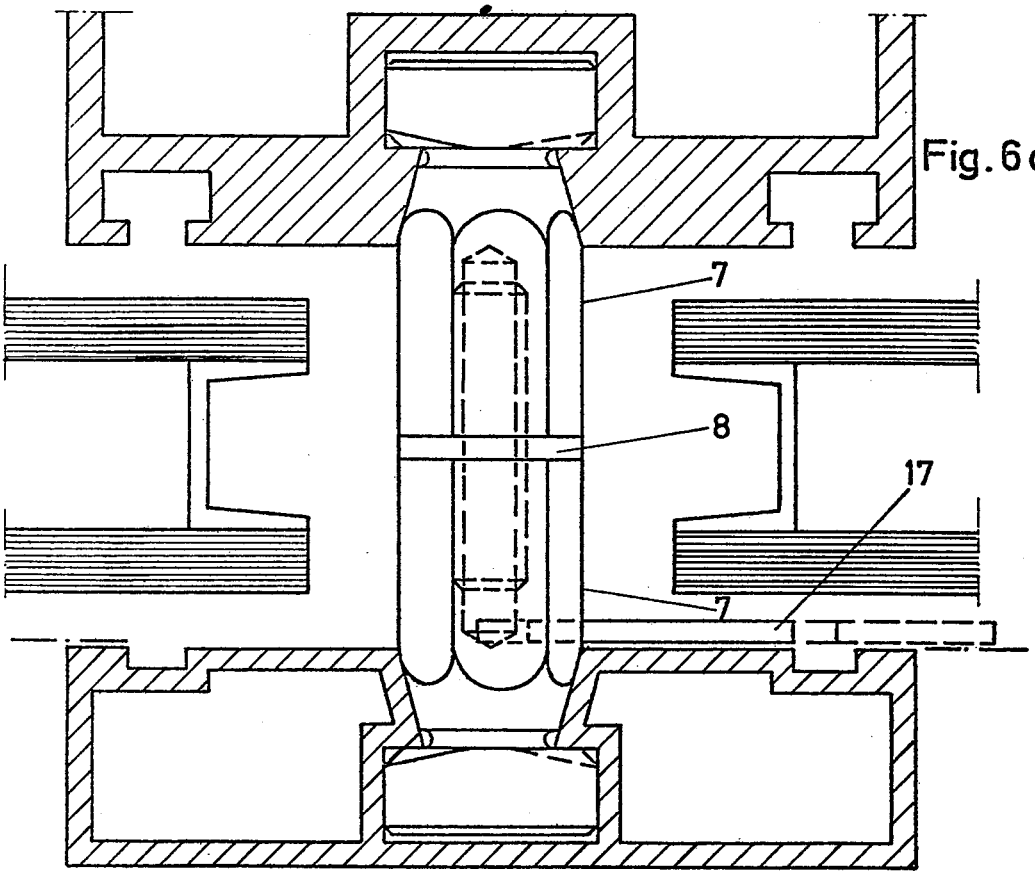

The sections to be joined are indicated by 1 and 2, and the device for joining as a whole by 3. These sections 1, 2 have at least one groove 4 running lengthwise on the sides which face each other. These grooves 4 are undercut on both sides and have therefore approximatly a T-shape in cross section. The flanges 5 which form the limits of the grooves 4 have, on their front side, sloping surfaces which run preferably towards the interior of the section and counter to each other and serve as stops for the connecting device 3. The connecting device 3 has a cross section the shape of a round bolt or spindle. This is made preferably out of a heat insulating material (e.g. plastic). It is made up of the fork-shaped piece 6, rectangular parallelopipedon 7 having a rhomboidal configuration in transverse section (hereinafter termed "rhomboidal head") and a spacer 8 as shown in FIGS. 1*a* and 5*a*. These parts are arranged coaxially and are held together by means of screw which is likewise coaxially positioned. The screw 9 requires an internal thread at least in fork-shaped piece 6. It can however also be replaced by a bolt fixed in a blind hole (not shown here), whereby the internal thread is omitted. It is also possible instead of an independent screw 9 or an independent bolt, to provide, as a conjugate part on the hammer head part 7, a plug which is pressed or injection mould cast on to part 7. However, as is shown in FIG. 2*a*, the device can be in one piece.

The fork-shaped part 6 exhibits on its end pointing towards section 1 two parallel fork-like arms 10 which are provided with snap fit projections 11 on their outward facing sides. The fork-like arms 10 engage in double undercut groove 4 in section 1 so that projections 11 anchor themselves behind flanges 5 with a snap fit. The arms 10 are preferably longer in the direction perpendicular to the long axis of the connecting device than broad in this plane (see FIG. 1*b*), so that fork-like part 6 can not rotate in groove 4. The fork-like part 6 is engaged firmly in groove 4 by pressing or if necessary with a blow. The screw 9 which is only then screwed up fully into place forces arms 10 outwards and thus ensures that fork-shaped piece 6 can not fall out. If screw 9 is loosened then fork-shaped piece 6 can be moved or dismantled.

The purpose of spacer 8 is to fix the desired distance between sections 1 and 2. It can, depending on the requirements e.g. thickness of the facade panels or panes of glass, be selected longer or shorter (in the direction of the long axis of the connecting device).

Rhomoboidal head 7 next to spacer 8 has its head 12 at its end facing towards section 2. In the top view of FIG. 1*b*, this is trapezium-shaped and only broad enough that it can be introduced into groove 4 of section 2. If it is as shown in FIG. 1*b* then rotated less than ¼ turn, for example, by about 75° then it engages in undercut groove 4 and so effects a connection with section 1 by being locked in place under force. In order to facilitate easy rotation in groove 4, the edges of the head 12 are made to slope in the direction of the long axis and towards the middle of the device so forming run-in surfaces 13. The actual head 12 changes to the shape of a cone 15 in the body of headed part 7. This cone 15, as with that in fork-shaped part 6, facilitates easy introduction and proper seating of the device in grooves 4 of sections 1, 2.

Figure 7A:
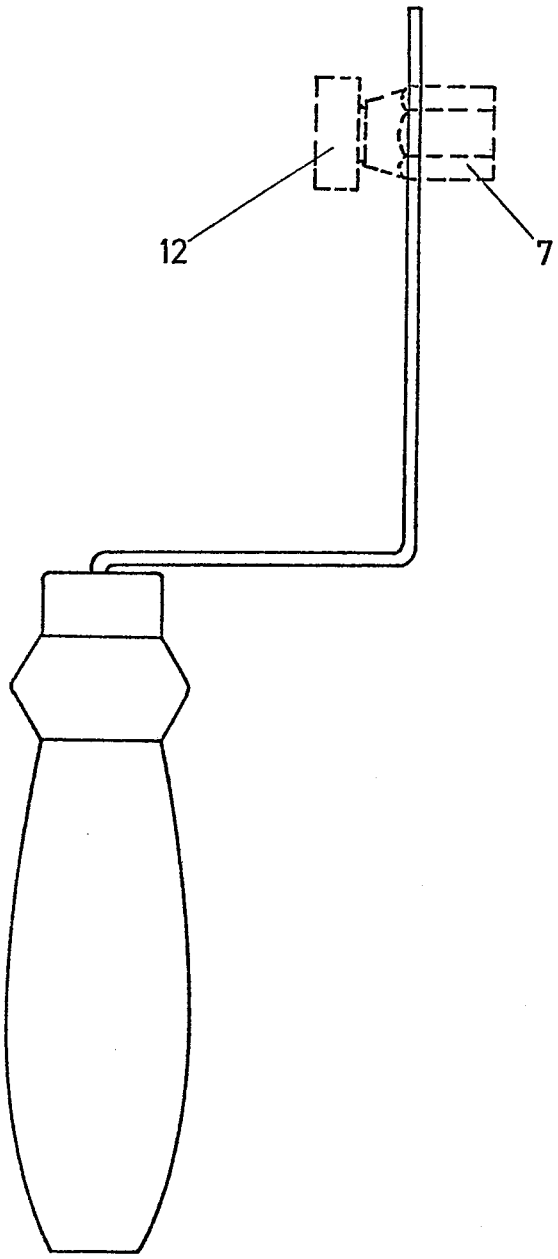
Figure 7B:
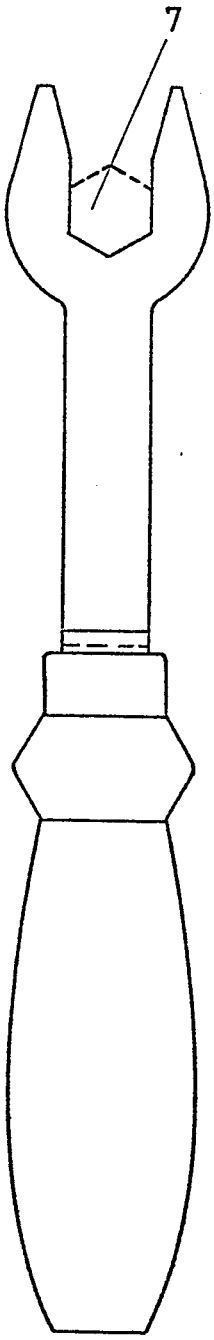

Under certain circumstances it can be useful to employ a metal headed screw instead of a plastic hammer-headed part 7, whereby in the former the head and the shaft of the screw form one piece and the shaft of the screw e.g. is screwed into the fork shaped piece 6 or into a second headed part 7. The screw 9 is securely held in the body 16 of the headed part 7 e.g. by being cast in. In order to rotate this, one uses an adjustable spanner as shown in FIGS. 7*a* and 7*b* which can grip two opposite faces on body 16 of part 7. For this reason body 16 in cross-section is usefully multi-sided e.g. with 4, 6 or 8 flat sides as in FIGS. 2*a* and 2*b* and the shaft of the adjustable spanner is offset twice at an angle of 90° (FIG. 7).

It is possible however, instead of an adjustable spanner, to provide on part 7, as an integral component, lamina rotating means 17 (FIGS. 1*a* and 1*b*), which extends perpendicular to and transversely from the long axis of the device. The hammer head 12 is rotated by means of this lamina until it engages in the undercut part of groove 4 of section 1 or 2 as may be the case.

In a preferred embodiment of the invention, instead of a fork-shaped and part, two parts 7 are used, only one of which bears a screw 9. A means for holding glass in place can also be formed out of one fork-shaped part 6 or one part 7 alone, together with a screw and a flat rail.

The flat rail can then have the shape of a disc 18 from which a segment has been cut away. At the assembly stage this is turned to the e.g. window-pane so that the straight edge 19 faces towards the side on which the first sheet of glass is to be put into place. If this sheet is in place and another sheet is to be mounted on the other side, then the straight edge 19 is turned 180° towards that side. When both sheets of glass have been put into place, then the disc is rotated so that straight edge 19 lies at a right angle to the long axis of the section. In this way both sheets of glass are held in place by the disc.

In practice a composite section is manufactured in such a way that a plurality of joining pieces of the invention are employed at intervals between two metal sections which are to be joined. The number used is determined by the size of the metal section and on the strength requirements which have to be satisfied in the construction.

What I claim is:

1. A device for releasably joining together two abutting structural unit frames, the facing sides of which are provided with grooves, undercut on each side thereof, in which the device engages, comprising a spindle, one end of which carries releasable means adapted to engage the undercut of a groove of said frame, and the other end of which carries a parallelopipedon of transverse rhomboidal cross-section rigidly and transversely attached thereto, the diagonal of said parallelopipedon being sufficiently long so that said parallelopipedon, when centered axially in said groove, engages the shoulders of said undercut when said spindle is rotated less than ¼ revolution.

2. A device according to claim 1, wherein said releasable means is a part having two parallel fork-like arms provided with snap-fit projections on their outward-facing sides adapted to engage the shoulders of said undercut with a snap-fit.

3. A device according to claim 1, wherein said spindle is cut transversely at its mid-point and the resulting halves are joined by an interior axial bolt, said bolt being fixed into and projecting from one of said halves and being retained in said other half by axial threads therein, whereby the two halves are rotatable with respect to each other.

4. A device, as claimed in claim 1, wherein the spindle carrying said parallelopipedon carries flat opposite sides, whereby said spindle can be rotated by a thin wrench when said device joins two undercut grooved frames.

5. A device, as claimed in claim 1, wherein the part of said spindle which carries said parallelopipedon carries a lamina projecting transversely from and perpendicular to the long axis of said spindle, whereby said spindle can be rotated when said device joins two undercut grooved frames.

* * * * *